US006192778B1

(12) United States Patent
Eggers

(10) Patent No.: US 6,192,778 B1
(45) **Date of Patent: *Feb. 27, 2001**

(54) CUTTING APPARATUS FOR SEPARATING PACKAGES FROM A LINE

(76) Inventor: Thies Eggers, Reichenhain 21, D-51789 Lindlar (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/241,920

(22) Filed: Feb. 2, 1999

(51) Int. Cl.[7] ..... B26D 7/06

(52) U.S. Cl. ..... 83/151; 83/510; 83/566; 83/86; 83/150; 83/167; 83/202; 83/487; 83/659; 83/945

(58) Field of Search ..... 83/510, 566, 86, 83/100, 150, 151, 152, 153, 160, 167, 202, 215, 216, 257, 343, 344, 346, 347, 348, 349, 487, 562, 659, 697, 949, 945, 946, 856, 857, 690, 691, 404, 409, 268, 276, 277, 278, 531, 534, 466.1, 914; 414/737; 425/292, 298

(56) References Cited

U.S. PATENT DOCUMENTS

| | | | | |
|---|---|---|---|---|
| 472,715 | * | 4/1892 | Rogowski | 83/510 |
| 2,453,599 | * | 11/1948 | Schlegel | 83/510 X |
| 2,692,630 | * | 10/1954 | Doolin | 83/857 X |
| 2,734,465 | * | 2/1956 | Head | 425/298 X |
| 2,950,693 | * | 8/1960 | Filiti et al. | 425/298 X |
| 3,224,311 | * | 12/1965 | Wagner | 83/345 |
| 3,566,736 | * | 3/1971 | Johnson et al. | 83/510 |
| 3,574,291 | * | 4/1971 | Rosendahl | 83/945 X |
| 3,701,297 | * | 10/1972 | Kovic | 83/409 X |
| 3,766,702 | * | 10/1973 | Meissner et al. | 53/30 |
| 3,808,927 | * | 5/1974 | Neil | 83/945 X |
| 4,872,382 | * | 10/1989 | Benner, Jr. et al. | 83/152 |
| 5,222,422 | * | 6/1993 | Benner, Jr. et al. | 83/152 X |
| 5,225,213 | * | 7/1993 | Brown et al. | 425/292 |
| 5,502,951 | * | 4/1996 | Oliverio et al. | 53/455 |
| 5,622,742 | * | 4/1997 | Carollo | 426/279 |

FOREIGN PATENT DOCUMENTS

| | | | | |
|---|---|---|---|---|
| 2037768 | * | 2/1972 | (DE) | 83/510 |
| 2550351 | * | 11/1976 | (DE) | 83/510 |

* cited by examiner

*Primary Examiner*—Rinaldi I. Rada
*Assistant Examiner*—Boyer Ashley
(74) *Attorney, Agent, or Firm*—Edwin D. Schindler

(57) ABSTRACT

A cutting apparatus for separating packages from a line of interconnected packages. The technical problem is to simplify the cutting apparatus and shorten the set-up times and the work cycles. This problem is achieved with a lower knife (4) capable of being moved in between the packages in the vertical direction from below and with an upper roll (12) capable of being moved, together with a discharge gripper (11) for the separated packages, parallel to the conveying section while being pressed against the lower knife.

8 Claims, 6 Drawing Sheets

CUTTING APPARATUS FOR SEPARATING PACKAGES FROM A LINE

BACKGROUND OF THE INVENTION

1. Technical Field of the Invention

The invention relates to a cutting apparatus for separating packages from a line.

The field of application of the invention is, in particular, the cutting-out of single thermoplastic cups during the online production, filling and packaging thereof. The thermoplastic cups receive food preparations such as cottage cheese or other milk products, pudding, jam, beverages or the like. It also applies analogously, however, to plane cardboard blanks.

2. Description of the Prior Art

The cutting-out is normally effected by a punching cut with an upper knife and a lower knife. The upper knives have to be precisely aligned with the lower knives. This involves a great deal of difficulty. Special upper knives and lower knives are required for each cutting pattern. When changing over to another cutting pattern, these upper knives and lower knives must in each case be set precisely. A drop-through punch has to be employed for the processing of thermoplastic cups with a circular cross section.

DE 78 16 238 U1 describes a roller punch in which a pivotable punching knife resting on interconnected packages to be cut is, for the cutting, moved through between two pressure rollers. The cut packages can be removed after the punching knife has been moved back and swung up, so that the mode of operation is very time-consuming.

SUMMARY OF THE INVENTION

The object of the invention is to simplify the cutting apparatus and shorten the set-up times and the work cycles.

This object is achieved according to the invention by designing the cutting apparatus with a lower knife capable of being moved in between the packages in the vertical direction from below and with an upper roll capable of being moved, together with a discharge gripper for the separated packages, parallel to the conveying section while being pressed against the lower knife.

The invention differs from the prior art in that only a lower knife which is adapted to the cup cross section and cup batch is in each case required for the cutting, while the upper roll is to a large extent universally usable. The use of an upper roll makes it possible to provide very narrow edges in the lower knife at the end edge of the thermoplastic cups, so that even round cups can be readily held in the lower knife and picked up by a gripper.

Particularly simple guidance of the upper roll is achieved by virtue of the fact that the upper roll and the discharge gripper are seated on a slide moved by a drive belt.

Secure mounting of each single blank is ensured by virtue of the fact that the lower knife has chambers with a bearing edge for each single blank.

Gentle cutting is achieved by virtue of the fact that the upper roll is designed as a squeeze roll.

The cutting conditions can be varied in that the squeeze roll comprises rings arranged side by side in the axial direction.

An individual radial movement of the rings and thus compensation for tolerances are achieved by virtue of the fact that each ring is supported on a supporting ring in such a manner as to yield in the radial direction.

The resistance to wear is increased by virtue of the fact that the rings are made of steel.

An optimization of the cutting pressure is possible by virtue of the fact that a shaft of the upper roll is supported in rails and that the rails are adjustably held on a tool carrier.

Optionally, a design in which the upper roll is designed as a knife roll is also possible.

BRIEF DESCRIPTION OF THE DRAWING FIGURES

Exemplary embodiments are explained with reference to the drawings, in which.

DETAILED DESCRIPTION OF THE DRAWING AND PREFERRED EMBODIMENTS

Figure 1:
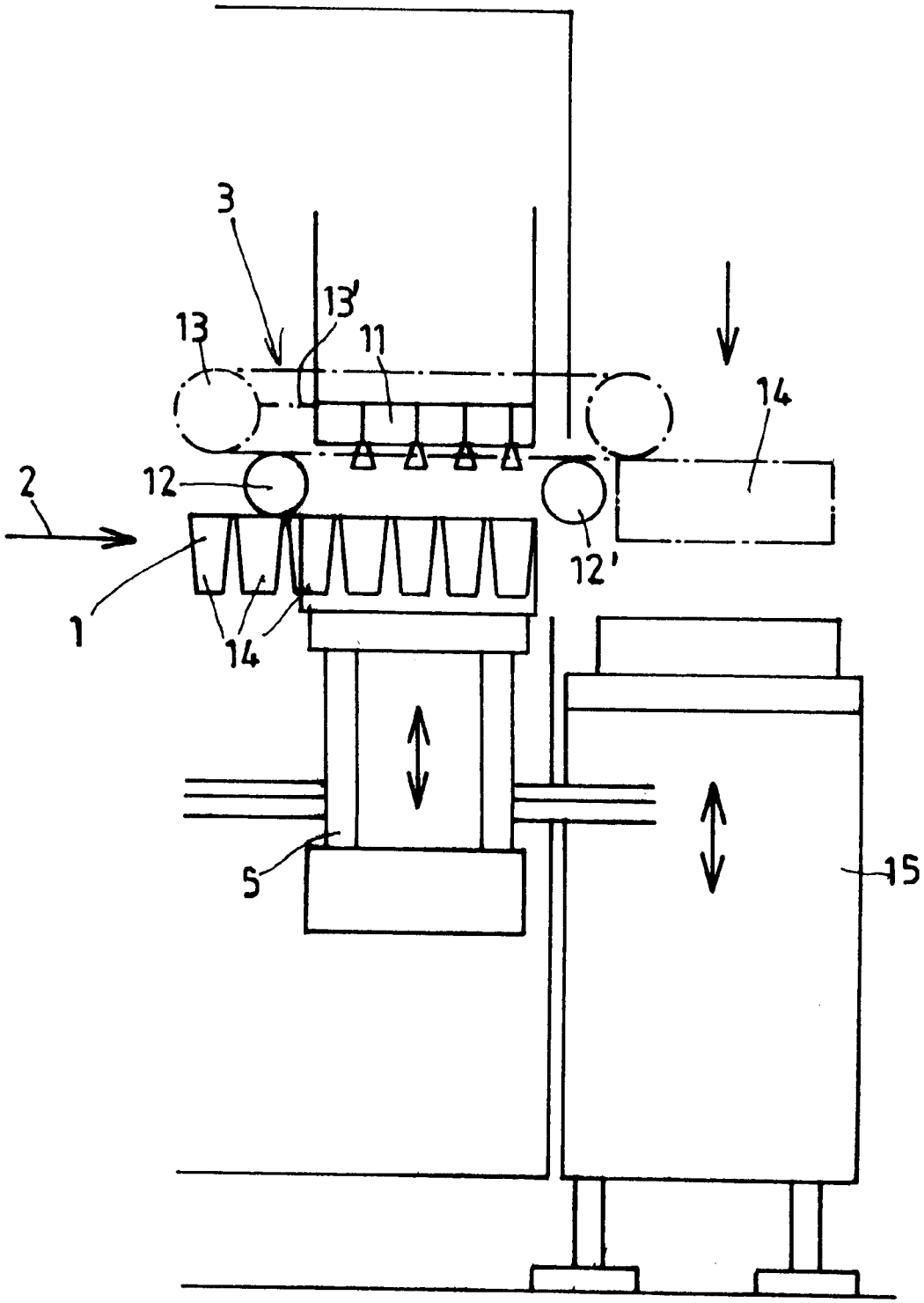
FIG. 1 shows a schematic view of the cutting apparatus.
Figure 2:
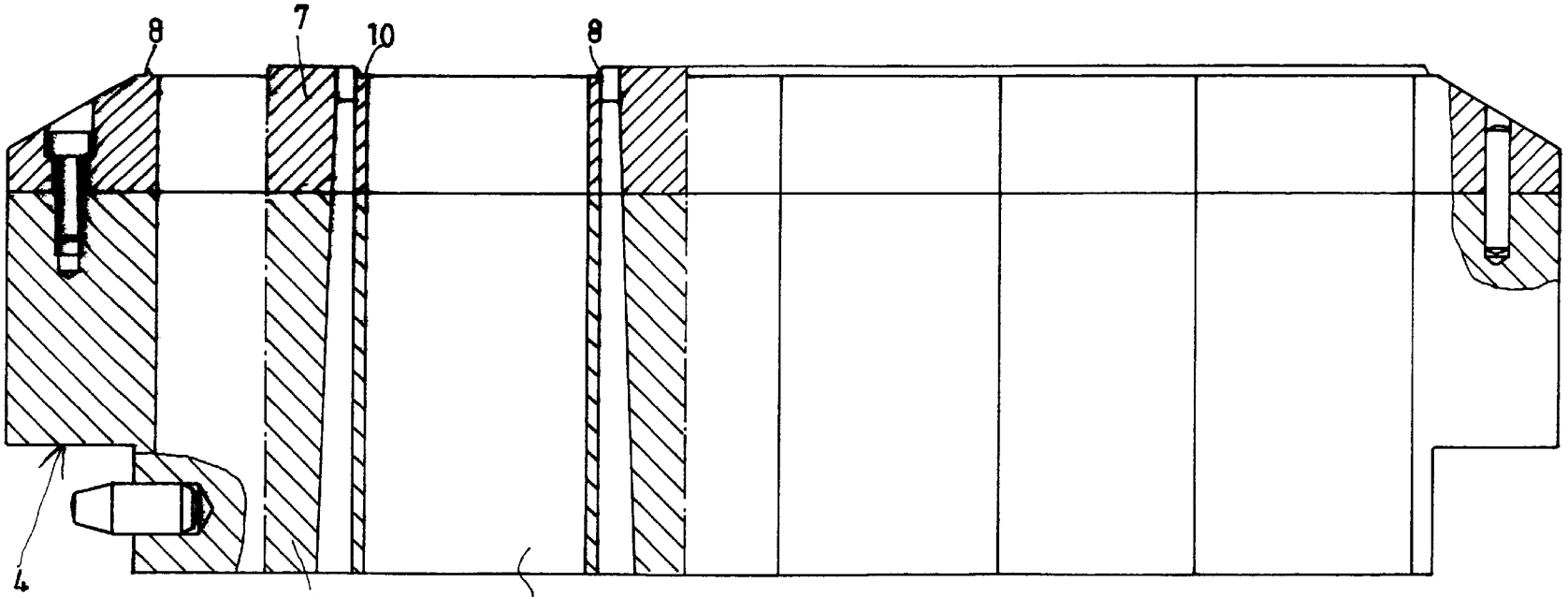
FIG. 2 shows a section through the lower tool of the cutting apparatus.
Figure 3:
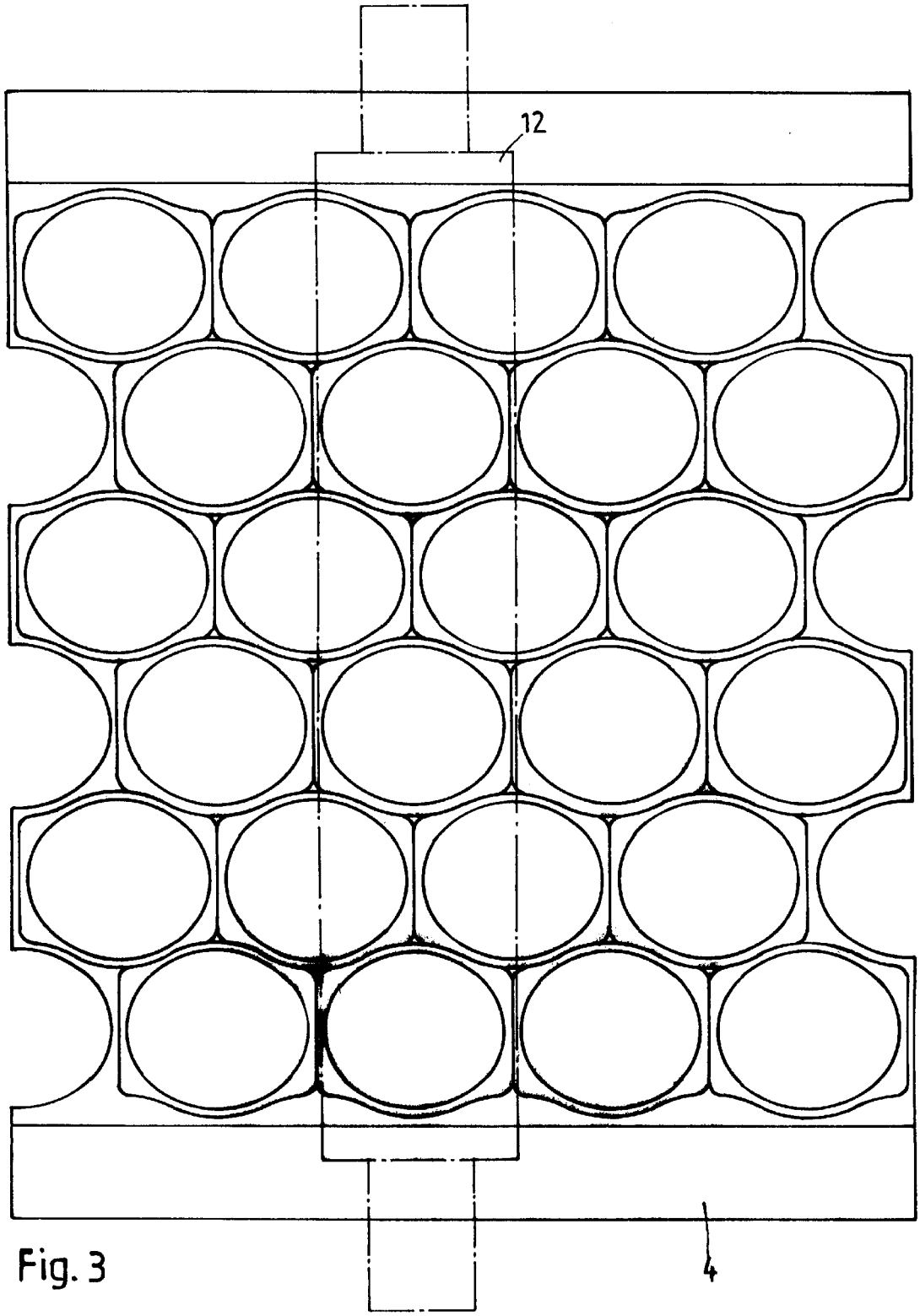
FIG. 3 shows a plan view of the cutting apparatus.

The invention is described with reference to a filling plant for filling thermoplastic cups 1 with a food preparation. Thermoplastic cups 1 which have been filled and closed with a lid foil (not shown) are moved batchwise (not shown in detail) in a conveying section in the conveying direction 2. The thermoplastic cups 1, which are interconnected in a line at the upper edge, must be cut and separated in a cutting apparatus 3.

The cutting apparatus 3 comprises a lower knife 4, which is arranged on a lifting table 5 or tool carrier. Seated on a top plate 6 is a cutting plate 7 or contour plate with cutting edges 8. The lower knife 4 has chambers 9 with a bearing edge 10, bounded by the cutting edges 8, for receiving the thermoplastic cups 1. After the thermoplastic cups 1, still interconnected in a line, have been moved above the lowered lower knife 4, the lifting table 5 with the lower knife 4 moves up, so that one thermoplastic cup 1 is seated in each chamber 9.

The cutting apparatus 3 further includes a discharge gripper 11 and a squeeze roll 12, which are seated on a slide moved by a drive belt 13. Starting from the position 12', the squeeze roll 12 is moved opposite the conveying direction 2 over the lower knife while being pressed against it. In the process, the end edges of the thermoplastic cups are cut out. The bearing edge 10 may be very narrow; cups with a circular cross section are also securely held on the bearing edge 10.

The drive belt 13 moves the slide 13' cyclically to and fro. In the ending position (which is opposite the starting position 12') of the squeeze roll 12, the cups are cut and are picked up by the discharge gripper 11, and the lifting table 5 is lowered. As the slide 13' travels forward, a batch 14 of the thermoplastic cups 1 is brought into a packing station 15 and deposited there.

In the meantime, a further batch 14 of thermoplastic cups 1 has moved into the cutting apparatus 3. The lifting table 5 moves up. During the movement of the drive belt 13 opposite the conveying direction 2, the squeeze roll 12 cooperates with the lower knife 4, so that the sealed thermoplastic cups 1 are separated in the lid region.

Figure 4:
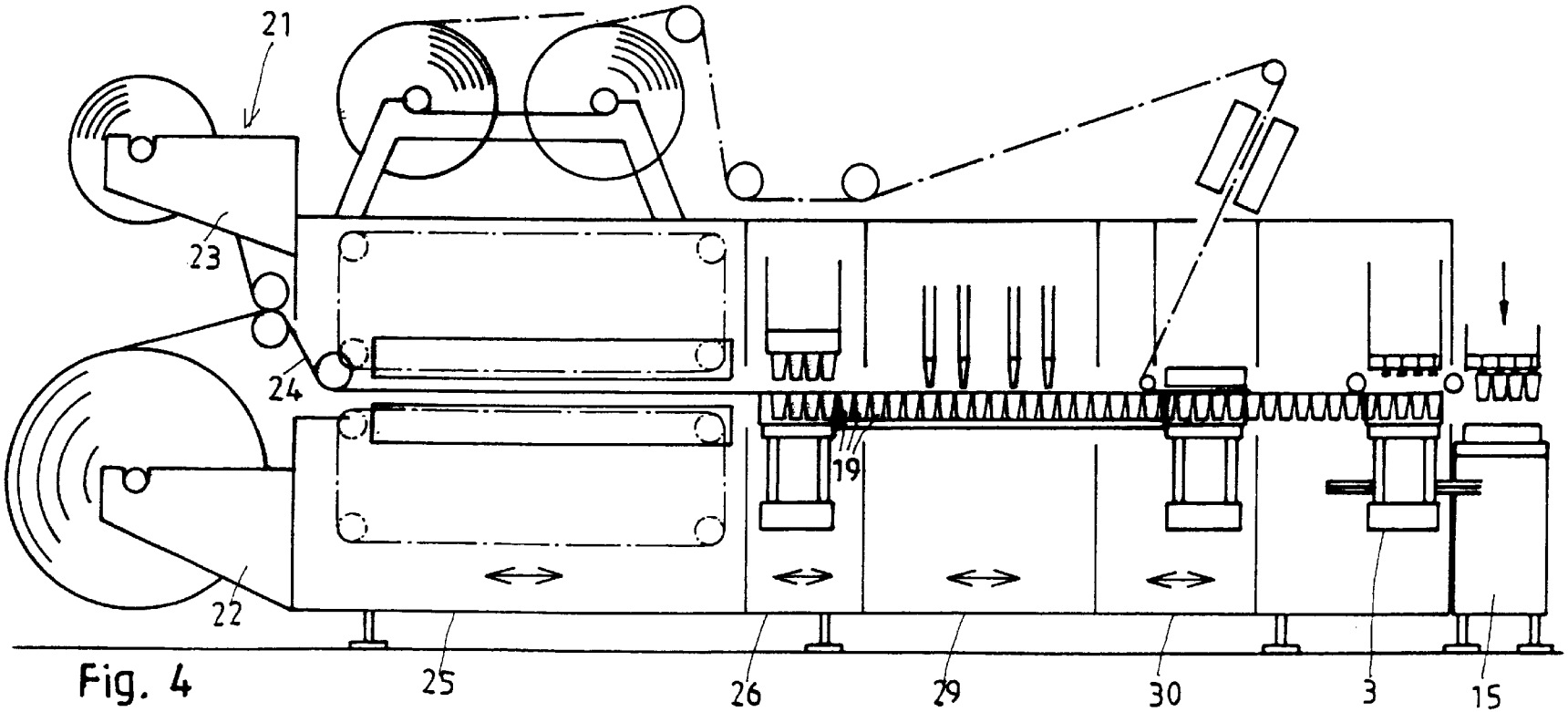
FIG. 4 shows a general view of a cup-forming and filling plant with a cutting apparatus.

FIG. 4 is a schematic general view of a filling plant. The latter comprises the following essential stations for the processing of the thermoplastic cups:

an alternating unwinder 21 with two unwinding receptacles 22, 23 for two reels of thermoplastic sheets 24, which are alternately unwound;

a continuous conveying section with conveying rolls, holders and grippers (not shown in detail). The conveying section is set for a cyclical or batchwise movement of the thermoplastic sheet and the thermoplastic cups in the conveying direction 2;

a heating station 25 for heating the thermoplastic sheet 24 to the thermoforming temperature;

a thermoforming station 26 for forming the thermoplastic cups 1;

a filling station 29 for filling the thermoplastic cups 1;

a sealing station 30 for heat sealing a lid foil onto the filled thermoplastic cups;

the above-described cutting apparatus 3, from which the separated thermoplastic cups 1 are conveyed into a packing station 15, where the separated thermoplastic cups 1 are put into trays, cartons, pallets or other transport containers. The following stations for final packaging are not shown.

The cutting apparatus 3 is arranged substantially fixed, since it is scarcely possible to set the following packaging sections so as to be displaceable. To be able to adapt the plant to a change of cup size and batch size, the heating station 25, the thermoforming station 26, the filling station 29 and the sealing station 30 are adjustable in the conveying direction, as indicated by the double arrows. The filling plant can thus be optimally adjusted to the particular size.

Figure 5:
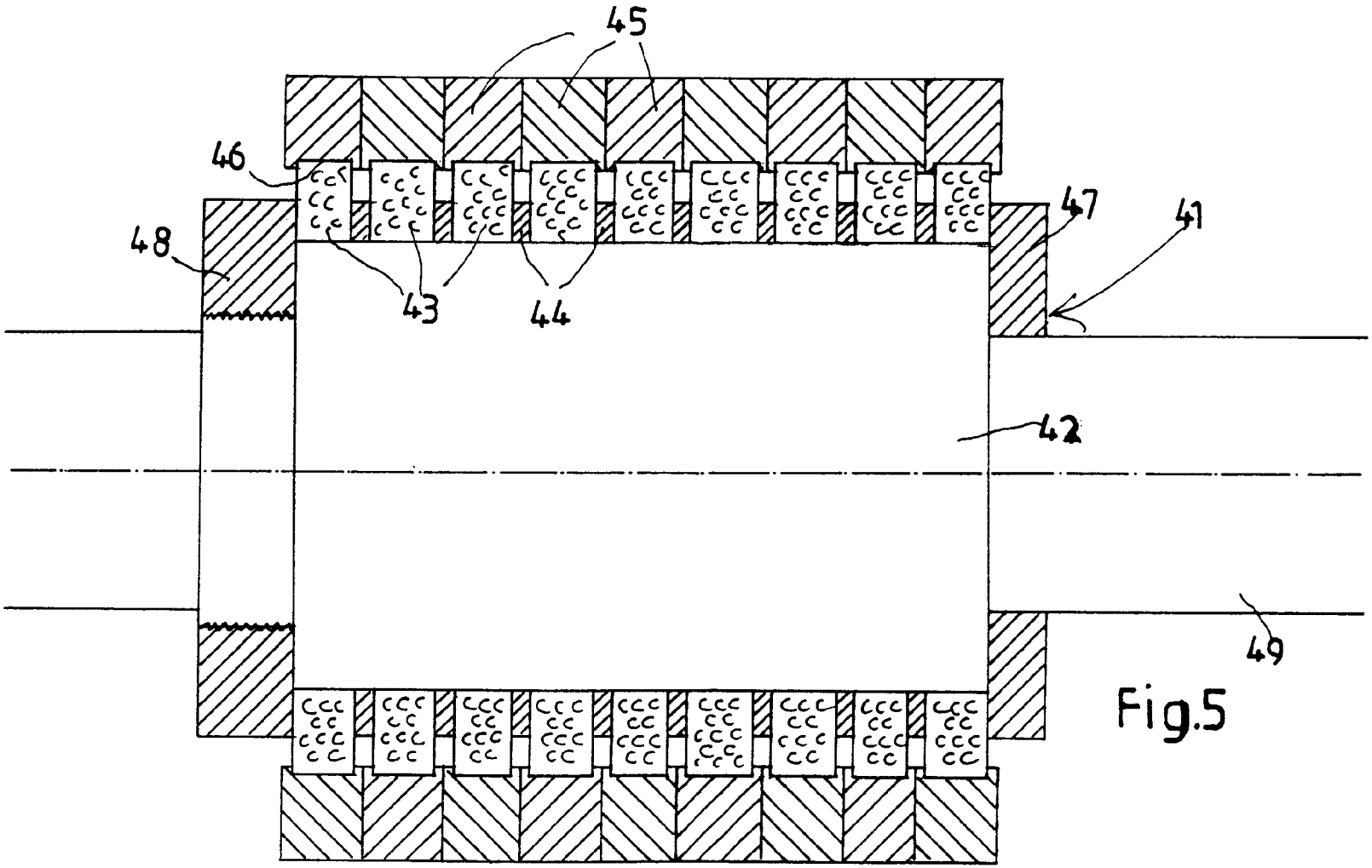
FIG. 5 shows a section through a modified upper roll.

FIG. 5 shows a squeeze roll 41 comprises of ring sections which yield in the radial direction so that, over the axial extent of the squeeze roll 41, individual adaptation to the articles to be cut and to the cutting geometry is possible.

Supporting rings 43 made of an elastically yielding material such as polyurethane are arranged on a cylindrical body 42. The supporting rings 43 are each separated by spacer rings 44. Each supporting ring 43 receives an outer ring 45 made of hard material such as steel. Each ring 45 engages, with a groove 46 in the inner face, over the associated supporting ring 43. The arrangement described is held together, between a stop 47 and a clamping ring 48, on a shaft 49. Each ring 45 can move individually in the radial direction, so that adaptation to different cutting conditions and compensation of tolerances are possible.

Figure 6:
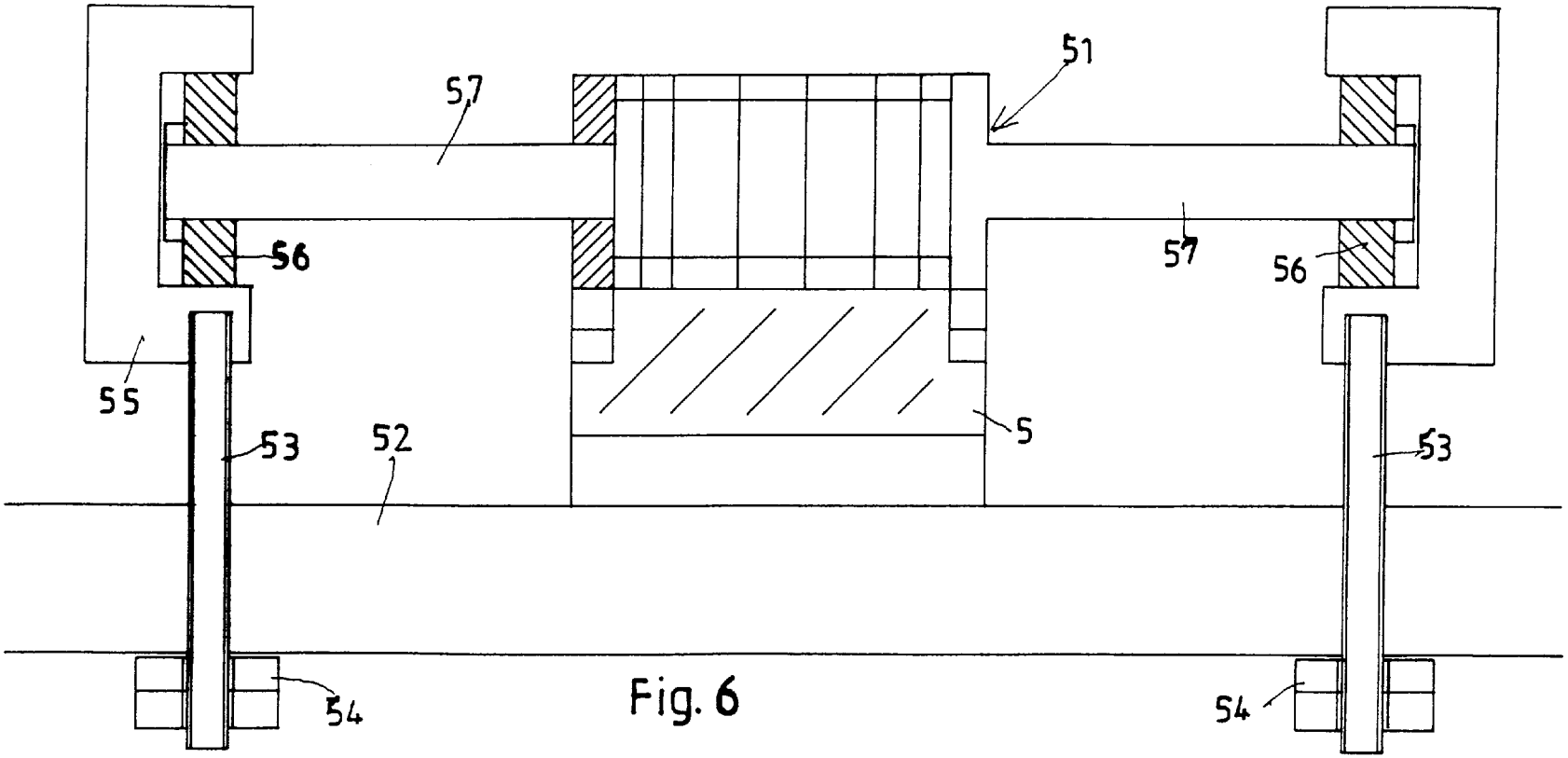
FIG. 6 shows a section through an upper roll designed as a knife roll.

FIG. 6 shows a design of the upper roll as a knife roll 51 which cooperates, in the manner of a roller punch, with the lower knife 5. This is advantageous in some applications. The lower knife 5 is seated on a tool carrier 52.

In the tool carrier 52, spindles 53 are guided in the vertical direction and are displaceable by spindle nuts 54. The drive of the spindle nuts 54 is not shown in detail. The spindle nuts 54 carry rails 55, in which rollers 56 run. The rollers 56 carry the shaft 57 of the knife roll 51. The spindles 53 enable precise adjustment of the rails 55 and thus of the cutting pressure.

What is claimed is:

1. A cutting apparatus for separating packages from a line of interconnected packages, comprising:

conveyor means for moving the line of interconnected packages;

a lower knife movable in a vertical direction to said conveyor means in between packages in the line of interconnecting packages for forming a series of separated packages;

a slide;

a drive belt;

a squeeze roll seated on said slide movable by said drive belt, said squeeze roll being parallel and movable in a direction opposite to a conveying direction of said conveyor means and over said lower knife, while being pressed against said lower knife; and, a discharge gripper for the series of separated packages, said discharge gripper being seated on said slide and being movable with said squeeze roll.

2. The cutting apparatus for separating packages from the line of interconnected packages according to claim 1, wherein said lower knife is set for simultaneously separating a plurality of packages and wherein said discharge gripper is set for simultaneously picking-up said plurality of packages.

3. The cutting apparatus for separating packages from the line of interconnected packages according to claim 1, wherein said lower knife includes chambers have a bearing edge for a thermoplastic cup.

4. The cutting apparatus for separating packages from the line of interconnected packages according to claim 1, further comprising a tool carrier, wherein said squeeze roll includes a shaft which is supported in rails, wherein said rails are adjustably held on said tool carrier.

5. The cutting apparatus for separating packages from the line of interconnected packages according to claim 1, wherein said squeeze roll is constructed as a knife roll.

6. The cutting apparatus for separating packages from the line of interconnected packages according to claim 1, wherein said squeeze roll comprises rings arranged side-by-side in an axial direction.

7. The cutting apparatus for separating packages from the line of interconnected packages according to claim 6, wherein each of said rings of said squeeze roll is supported on a supporting ring, so as to yield in a radial direction.

8. The cutting apparatus for separating packages from the line of interconnected packages according to claim 7, wherein said rings of said squeeze roll are made of steel.

* * * * *